United States Patent [19]

Brown

[11] 4,186,869

[45] Feb. 5, 1980

[54] MAIL BOX

[76] Inventor: Charles E. Brown, P.O. Box 1875, Hereford, Tex. 79045

[21] Appl. No.: 904,903

[22] Filed: May 11, 1978

[51] Int. Cl.[2] ..... A47G 29/12

[52] U.S. Cl. ..... 232/17; 232/34; 232/48

[58] Field of Search ..... 232/17, 28, 38, 45, 232/47, 48, 49, 50, 43.1, 43.2, 43.5, 39; 312/319

[56] References Cited

U.S. PATENT DOCUMENTS

| | | | |
|---|---|---|---|
| 438,476 | 10/1890 | Groom, Jr. | 232/39 |
| 661,361 | 11/1900 | Weaver | 232/39 |
| 736,181 | 8/1903 | Weglein, Jr. | 232/39 |
| 1,127,192 | 2/1915 | Cox | 232/39 |
| 1,202,251 | 10/1916 | Van Dorn | 232/39 |
| 1,483,077 | 2/1924 | Cole | 232/34 X |
| 1,810,769 | 6/1931 | Jaden | 232/17 X |
| 3,713,259 | 1/1973 | Tkach | 52/296 X |
| 3,735,919 | 5/1973 | Morgan | 232/17 |

*Primary Examiner*—Ramon S. Britts
*Assistant Examiner*—Peter A. Aschenbrenner
*Attorney, Agent, or Firm*—Wendell Coffee

[57] ABSTRACT

A mail box is shaped like a post which is to say it has a housing in the shape of a rectangular prism. The letter box pivots at its bottom front from the top of the housing. The amount the letter box pivots outward is adjustable and a weight on the rear of the letter box tends to pull it closed. The letter box is particularly adapted for urban and suburban placement where the mailman delivers the mail from a vehicle or where the mailman does not deliver the mail to a door side box.

16 Claims, 6 Drawing Figures

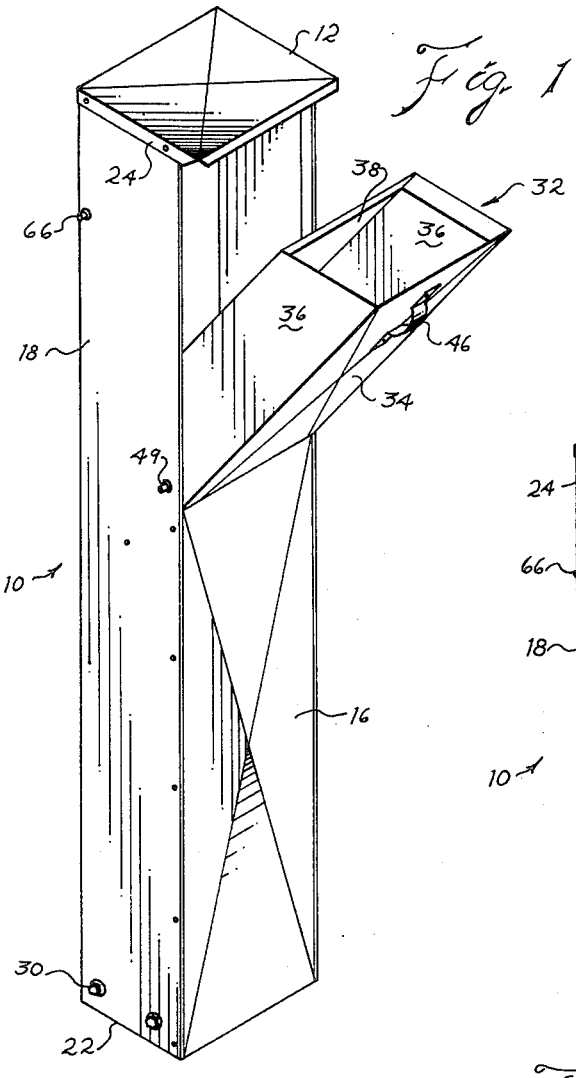
Fig. 1
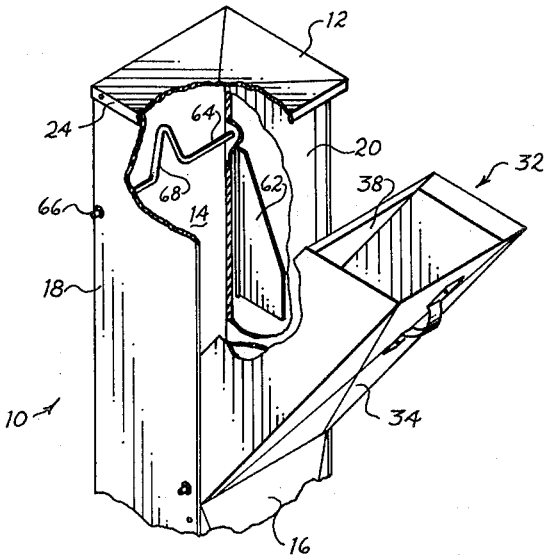
Fig. 2
Fig. 5
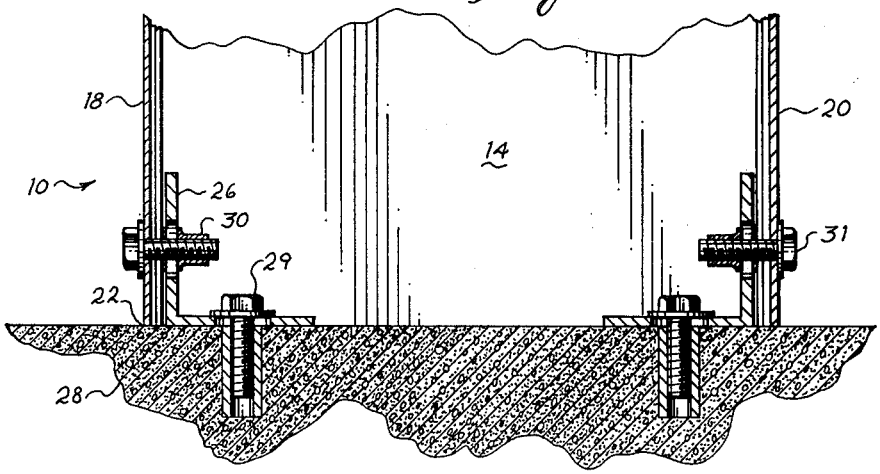

MAIL BOX

BACKGROUND OF THE INVENTION (1) Field of the Invention

This invention relates to deposit and collection receptacles and more particularly to mail boxes.

(2) Description of the Prior Art

Much of the mail today is delivered by mailman from vehicles. Often, the vehicles deliver it in suburban areas. There is a desire for mailboxes which are pleasing in appearance and also well adapted to be self supporting and to have the mail protected. Also, when the mail boxes are in rural areas on the edge of roadways, it is desired that they be constructed so that the box itself does not form a missile in the windshield of a vehicle if struck at high speed.

In suburban locations often the mail is not delivered to the door of the house but the patrons are required to place a box on the sidewalk or adjacent to the sidewalk. It is desirable in such a case to have a box which obstructs the sidewalk as little as possible and also does not form a hazard for children playing or riding bicycles upon the sidewalks.

Before this patent application was filed, a search was made in the U.S. Patent and Trademark Office. The following U.S. Patents were discovered upon that search.

Bishop—U.S. Pat. No. 636,947
Waltermire—U.S. Pat. No. 1,215,753
MacDonald—U.S. Pat. No. 1,327,957
Stay—U.S. Pat. No. 1,759,667
Jaden—U.S. Pat. No. 1,810,769
Roe—U.S. Pat. No. 2,352,975
Duppelhammer—U.S. Pat. No. 2,421,603
Mioduski—U.S. Pat. No. 2,988,268
Lindahl—U.S. Pat. No. 3,080,107
Gegax—U.S. Pat. No. 3,343,785
Morgan—U.S. Pat. No. 3,735,919
Caldwell—U.S. Pat. No. 3,968,928

MORGAN shows a box having the general configuration of this application. MORGAN discloses a rather complex upper and lower compartment arrangement so that the incoming mail is dropped to a lower locked compartment as soon as the door is closed. There is an arrangement wherein outgoing mail may be retained in the upper compartment.

GEGAX discloses a mail box having a tilted or pivoted letter box somewhat similar to this application.

WALTERMIRE discloses a mail box having a tilting letter box with the travel of the letter box limited.

The remainder of the references do not seem as pertinent as those specifically discussed above.

SUMMARY OF THE INVENTION

New and Different Functions

I have invented a mail box that is well adapted to be mounted either upon a concrete base in a rural area or upon sidewalks or adjacent to sidewalks in a suburban area. In either event, it has a minimum of obstruction to traffic and yet it is well adapted to have mail deposited and collected either from a vehicle or by a pedestrian. The height at which the letter box opens is readily adjustable by a cord and weight arrangement so that it may be easily adjusted to the height of the vehicle, if the mail is delivered by vehicle.

Therefore it may be seen that the total function of my mail box is far greater than the sum of the functions of the individual rods, bolts, boxes, etc.

Objects of this Invention

An object of this invention is to provide a mail box.

Further objects are to achieve the above with a device that is pleasant appearing, sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a perspective view of an embodiment of my invention with the letter box shown open.

FIG. 2 is a perspective view of the top portion thereof with letter box open and with parts broken away to show the mounting of the flag.

FIG. 5 is a sectional view of the bottom of the box showing the attachment of the box to a concrete support structure.

DETAILED DESCRIPTION OF THE PREFERRED EMBODIMENT

Figure 3:
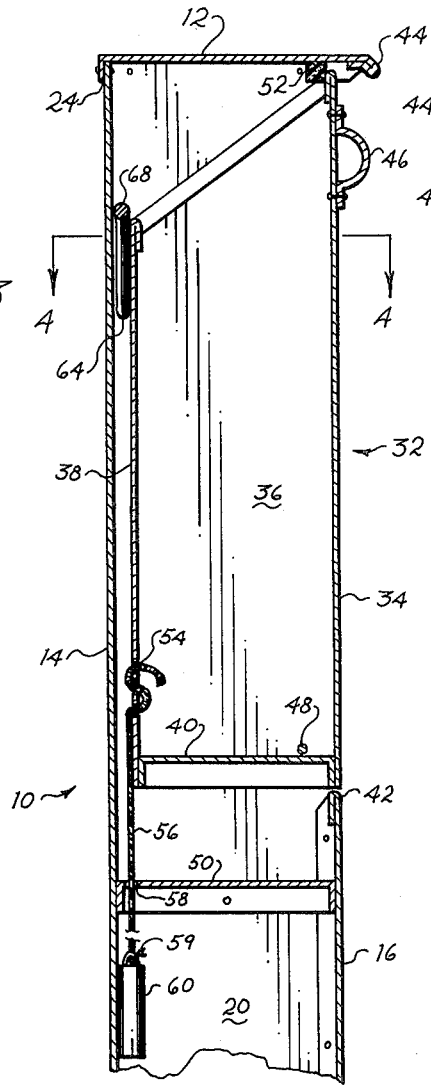
FIG. 3 is a sectional view taken substantially on line 3—3 of FIG. 4 with the letter box closed and the cord foreshortened.
Figure 6:
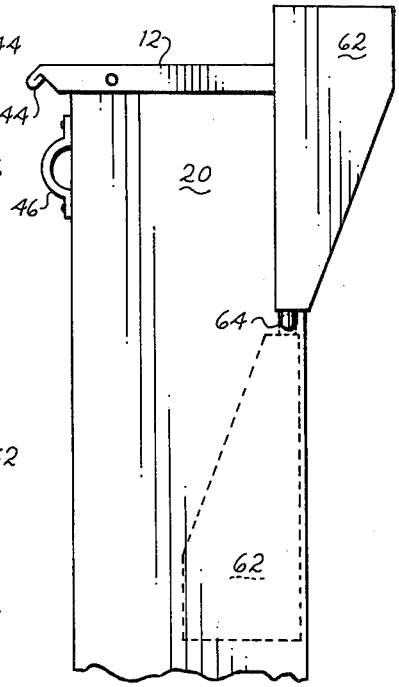
FIG. 6 is a flag side elevational view with the flag shown up in full lines and the flag shown down in broken lines.

Referring to the drawings, particularly FIG. 1, it may be seen that a mail box according to my invention has housing 10 which is shaped somewhat like a post or technically the shape of a rectangular prism. The housing 10 includes cap 12, back 14, front 16, blank side 18, and flag side 20. As may be seen the back 14 and the two sides 18 and 20 are made of a single sheet of sheet metal. The sheet metal is fabricated so that it has a U-shape in cross section as may be seen in FIG. 4.

It will be understood that the mail box could be constructed of any material specifically including being molded of a synthetic plastic material.

In any event, the back 14 and each of the sides 18 and 20 of the housing are rectangular and extend from the bottom 22 of the housing to the top of the housing as represented by the cap 12. The back 14 is rigidly attached to the two sides, as shown by being a sheet of single material. The cap 12 is rectangular and is rigidly attached to the back 14 and two sides 18 and 20. The cap is formed with lip 24 extending over the back 14 and two sides 18 and 20 and the lip is rigidly attached as by rivets, although it will be understood that any of the normal fabrication procedures could be followed.

The front 16 extends from the bottom 22 of the housing to above halfway between the bottom and top. The front 16 is rigidly attached to the two sides 18 and 20 by standard procedures.

Angle clips 26 form a portion of anchor means by which the housing is anchored to supporting structure 28. As previously pointed out in suburban areas the supporting structure might well be a concrete sidewalk, whereas in rural areas the supporting structure might be a block or independent slab of concrete so that the box with its supporting structure would be portable. The angle clips 26 have two legs each having elongated slots therein. One of the legs is against the supporting structure 28 and is held securely in position by masonry bolts 29 which are placed into the holes in the masonry substance by inserts as is common. The sides have side bolts 31 extending from outside of the box through elongated slots and onto nuts or threaded clips 30.

Figure 4:
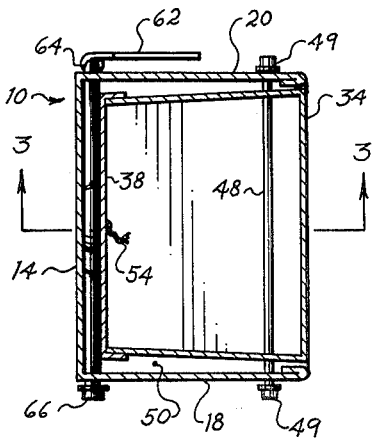
FIG. 4 is cross section taken substantially on line 4—4 of FIG. 3.

Letter box 32 includes front 34, two sides 36, back 38, and bottom 40. The front, two sides, back and bottom are rigidly attached together. The front 34 and two sides 36 are constructed of a single sheet of material which is U-shaped in cross section, as seen in FIG. 4. The letter box front 34 and the housing box front 16, as well as the cap 12, are all cross-broke for additional rigidity and strength as well as appearance. Although the cross-breaking will cause a slight protrusion of these elements this has not been shown in FIG. 3 for clarity of the drawings. The letter box front 34 fills the space between the top 42 of the housing front 16 and the cap 12. The cap has an overhang 44 which extends over the top of the letter box front 34. A convenient opening handle 46 is provided near the top of the letter box front 34.

The letter box 32 is pivoted by box bolt 48. Box bolt 48 extends from the outside the blank side 18 through the sides of the letter box to outside the flag side 20. The box bolt 48 is located near the bottom and front of the letter box. Bolt stops 49 on each end of box bolt 48 hold the box bolt securely in the selected position. As illustrated, it may be seen that it is immediately above the letter box bottom 40 and spaced inwardly somewhat from the letter box front 34. The top of the letter box sides 36 slope downwardly from the front 34 to the back 38 so that they clear the cap overhang 44 when the letter box is pivoted open.

As may be seen, all exposed edges of the metal are folded over so that all edges are smooth, eliminating the possibility of cuts, either to the mailman or the patron. This particularly includes the overhang 44 and the top of all four edges of the letter box as well as the exposed edges of the blank side 18 and the flag side 20. Also referring to FIG. 4, it may be seen that the back of the letter box has greater clearances to the housing sides 18 and 20 than does the front 34. This prevents any binding of the sides as the letter box is opened but still does not prevent a good, tight snug fit of the front when closed. Of course, this is achieved by making the front 34 wider than the back 38 of the mail box, but of course, the same effect could be achieved by making the housing back 14 wider than the housing front 16.

False bottom 50 is attached to the front, back and two housing sides below the letter box 32. This not only provides rigidity to the housing, but also prevents any letters from being dropped into the housing and falling all the way to the support surface 28 where they would be extremely difficult to retrieve by the patron.

For a pleasing appearance and also for utility as well as appearance, I have found it desirable to have the box well over four times as high as wide. The front 34 of the letter box is over twice as high as it is wide (18.7×8.2 inches or 47×21 cm). Specifically, I have found by having the entire mail box 48 inches (118 cm) high and having the front 8.2 inches (21 cm) wide and the sides 6.2 inches (16 cm) deep both has good utility as well as pleasing appearance.

Resilient bumper 52 extends across the entire front of the cap at the bottom so that when the letter box 32 is closed the top of the letter box front 34 firmly contacts the bumper. This prevents any possibility of a driving rain or snow from blowing inside the mail box.

Three holes 54 are formed and vertically aligned in the bottom of the letter box back 38. Cord 56, similar to a sash cord, is trained through these holes in a serpentine configuration as seen in FIG. 3. The cord 56 extends on the outside of the letter box at the bottom hole and extends through an apperture 58 in the false bottom 50. A stop 59 is formed on the end of the cord 56. This stop 59 may be in the form of a knot or in the form of a weight 60 similar to a sash weight. An anaylsis will show that the amount which the letter box 32 may be opened will depend upon the length of the cord 56 from the bottom hole 54 to the stop 59. Therefore, if the mailman wishes the letter box to be lower so that he can more conveniently deliver mail to the letter box 32 from his vehicle, he may merely increase the length of the cord by feeding of the cord 56 through the holes 54. If he desires for it to be higher, he can merely pull some of the cord 56 into the letter box 32. In this way, the height of the box may be adjusted. It is preferred that the stop 59 be the top of a weight 60. In this manner, the weight 60 will bias the letter box 32 to a closed position so that it does not hang open exposing the contents to the elements and also presenting a hazard to pedestrians or playing children. It may be seen that the cord forms both a portion of a closure means to close the letter box and also a portion of an adjustable limit means adjustably limiting the outward movement of the letter box.

Flag 62 is rigidly attached to flag rod 64. The flag is pivoted. The flag rod 64 extends through the flag side 20 behind the letter box and through the blank side 18. Rod stop 66 upon the end of the flag rod 64 holds it in position. The flag rod 64 has an axis which is the center of the line between the blank side 18 and the flag side 20 wherein the flag extends. The flag 62 is at right angles or normal to the axis of the rod 64. Radial extension 68 is formed on the flag rod 64 in the back of the letter box. It is conveniently formed by bending the flag rod into a V configuration, as best seen in FIG. 2.

The flag is rigidly attached to the flag rod at the point of manufacture but can be shipped unassembled stored in a letter box. When the purchaser assembles the mail box, he can readily feed the flag rod through its hole in the flag side 20 and by manipulation around the V-shaped radial extension 68 feed it on through and through the blank side 18 and place the stop 66 on the end. The letter box is constructed so that when it is closed, the letter box firmly rests against the flag rod 64 and the radial extension 68. Therefore, if the flag 62 is raised with the letter box open and then letter box closed, the weight of the letter box 32 itself, being pivoted near the front, will hold the flag in a raised position. However, when the letter box is open, the flag 62 will fall by gravity to the lower position as seen in broken lines in FIG. 5. When the flag has fallen by gravity to the lower position, the radial extension 68, being in the same plane with the edge of the flag 62 will again act as a stop for the letter box 32. Therefore, it may be seen that the flag rod with its radial extension acts as a stop for the closing of the letter box 32 and the bumper 52 does not act as a stop but only to prevent foreign material from blowing into the mail box. As it may be seen, the flag rod 64 with radial extension 68 is below the top of the back 38 of the letter box 32.

Therefore, it may be seen that I have provided a letter box having a pleasing configuration and yet extremely simple to manufacture assemble and which may be shipped in a convenient size carton.

It will be understood that if desired, the mail box 10 can be divided in two sections at about the false bottom 50 so that the shipping carton could be of a reduced total length. Also it will be understood that in the event the mail box was to be cast of synthetic plastic material, that it would be desirable for it to be cast in two pieces for simplicity of making the mold inasmuch as the bottom portion would be a single casting including the false bottom and the top portion would be a single casting including the cap.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | housing | 40 | letter box bottom |
| 12 | cap | 42 | top |
| 14 | back (housing box) | 44 | cap overhang |
| 16 | front (housing box) | 46 | opening handle |
| 18 | blank side | 48 | box bolt |
| 20 | flag side | 49 | bolt stop |
| 22 | bottom | 50 | false bottom |
| 24 | lip | 52 | resilient bumper |
| 26 | angle clips | 54 | holes |
| 28 | supporting structure | 56 | cord |
| 29 | masonry bolts | 58 | apperture |
| 30 | threaded clips | 59 | stop |
| 31 | side bolts | 60 | weight |
| 32 | letter box | 62 | flag |
| 34 | letter box front | 64 | flag rod |
| 36 | letter box sides | 66 | rod stop |
| 38 | letter box back | 68 | radial extension |

I claim as my invention:

1. A mail box comprising:

a. a housing having the shape of a rectangular prism, b. said housing having
(i) a cap,
(ii) a back,
(iii) a front,
(iv) a blank side, and
(v) a flag side, c. the back and each of the sides being rectangular and extending from the bottom to the top of the housing, d. the back rigidly attached to the two sides, e. the cap rigidly attached to the back and two sides with f. a cap lip enclosing the back and two sides, g. the front extending from the bottom to past halfway to the top, and rigidly attached to the two sides, h. anchor means on the bottom of the housing for attaching the housing to supporting structure, j. a letter box having at least the following elements rigidly attached together,
(i) a front, and
(ii) two sides, k. the letter box pivoted to the housing near the bottom and front of the letter box sides, m. the letter box front filling the housing from the housing front to the cap, n. a false bottom rigidly attached to the back, sides, and front of the housing below the letter box, o. the cap having an overhang over the letter box front, and p. a flag pivoted to the flag side, q. said letter box having a back rigidly connected to the letter box sides, r. a flag rod to which the flag is rigidly attached, s. said flag rod pivoted through the flag side and blank side, t. said flag rod having a radial extension thereon in the same plane with the flag, u. said flag rod being below the top of the back of the letter box, v. so that the back of the letter box contacts said radial extension when the box is closed thereby holding the flag in a full up position or a full down position when the letter box is closed, and w. said flag being free to rotate by gravity when the letter box is pivoted open.

2. The invention as defined in claim 1 further comprising:

x. limit means operatively connected to the letter box for adjustably limiting the outward movement of said letter box.

3. The invention as defined in claim 2 further comprising:

y. closure means operatively connected to the letter box for biasing the letter box to a closed position.

4. The invention as defined in claim 3 further comprising:

z. said closure means and limit means include a cord adjustably attached at the back of the letter box, aa. said cord extending through an apperture in said false bottom, and bb. a weight on the end of the cord.

5. The invention as defined in claim 4 further comprising:

cc. said cord being adjustably attached to the back of the letter box by having holes through the back of the letter box and said cord trained through the holes in a serpentine configuration.

6. The invention as defined in claim 5 wherein dd. there is more clearance between the back of the letter box and the housing sides than there is between the front of the letter box and the housing sides.

7. The invention as defined in claim 6 wherein ee. there is greater clearance because the front of the letter box is wider than the back of the letter box.

8. The invention as defined in claim 7 further comprising:

ff. said letter box pivoted to the housing by a box bolt extending from outside the blank side through the housing to outside the flag side, and gg. stops on each end of the box bolt.

9. The invention as defined in claim 8 further comprising:

hh. the letter box front being over twice as high as it is wide.

10. The invention as defined in claim 9 further comprising:

jj. said front and two sides of the letter box fabricated from a single sheet of material which is a U-shaped in cross section.

11. The invention as defined in claim 10 further comprising:

kk. said housing back, flag side and said blank side fabricated from a single sheet of material which is U-shaped in cross section.

12. The invention as defined in claim 11 wherein mm. said housing and letter box are fabricated of sheet metal and all exposed edges are folded back.

13. The invention as defined in claim 12 wherein said anchor means includes nn. angle clip means having two legs, oo. one leg of each is bolted to the supporting structure and the other leg of each is bolted to one of said housing sides.

14. The invention as defined in claim 13 further comprising:

pp. a resilient bumper attached to the bottom of the cap and contacting the top of the letter box front when the box is closed.

15. A mail box comprising:

a. a housing having the shape of a rectangular prism, b. said housing having (i) a cap, (ii) a back, (iii) a front, (iv) a blank side, and (v) a flag side, c. the back and each of the sides beng rectangular and extending from the bottom to the top of the housing, d. the back rigidly attached to the two sides, e. the cap rigidly attached to the back and two sides with f. a cap lip enclosing the back and two sides, g. the front extending from the bottom to past halfway to the top, and rigidly attached to the two sides, h. anchor means on the bottom of the housing for attaching the housing to supporting structure, j. a letter box having at least the following elements rigidly attached together, (i) a front, and (ii) two sides, k. the letter box pivoted to the housing near the bottom and front of the letter box sides, m. the letter box front filling the housing from the housing front to the cap, n. a false bottom rigidly attached to the back, sides, and front of the housing below the letter box, o. the cap having an overhang over the letter box front, and p. a flag pivoted to the flag side, q. limit means operatively connected to the letter box for adjustably limiting the outward movement of said letter box, r. said letter box having a back rigidly connected to the letter box sides, s. said limit means includes a cord adjustably attached at the back of the letter box, and t. said cord extending through an apperture in said false bottom, to u. a stop on the cord beneath said false bottom.

16. The invention as defined in claim 15 further comprising:

v. said stop is in the form of a weight on the cord, whereby w. the weight also functions to bias the letter box to a closed position.

* * * * *